US011008890B2

(12) United States Patent
Lemoine et al.

(10) Patent No.: US 11,008,890 B2
(45) Date of Patent: May 18, 2021

(54) SEALING INTERFACE FOR A CASE OF A GAS TURBINE ENGINE

(71) Applicant: UNITED TECHNOLOGIES CORPORATION, Hartford, CT (US)

(72) Inventors: Jonathan Lemoine, Vernon, CT (US); Steven J Bauer, East Haddam, CT (US); Judith F Brooks, Palo Alto, CA (US)

(73) Assignee: Raytheon Technologies Corporation, Farmington, CT (US)

( * ) Notice: Subject to any disclaimer, the term of this patent is extended or adjusted under 35 U.S.C. 154(b) by 1445 days.

(21) Appl. No.: 14/948,700

(22) Filed: Nov. 23, 2015

(65) Prior Publication Data

US 2016/0146049 A1 May 26, 2016

Related U.S. Application Data

(60) Provisional application No. 62/084,066, filed on Nov. 25, 2014.

(51) Int. Cl.

| | |
|---|---|
| ***F01D 25/24*** | (2006.01) |
| ***F01D 25/16*** | (2006.01) |
| ***F01D 11/00*** | (2006.01) |
| ***F01D 9/06*** | (2006.01) |

(52) U.S. Cl.

CPC ..... *F01D 25/24* (2013.01); *F01D 9/065* (2013.01); *F01D 11/003* (2013.01); *F01D 11/005* (2013.01); *F01D 25/16* (2013.01); *F01D 25/162* (2013.01); *F05D 2220/32* (2013.01); *F05D 2230/20* (2013.01); *F05D 2230/60* (2013.01); *F05D 2230/80* (2013.01); *F05D 2230/90* (2013.01); *F05D 2240/14* (2013.01); *F05D 2240/54* (2013.01); *F05D 2240/58* (2013.01)

(58) Field of Classification Search

CPC ..... F01D 25/24; F01D 11/003; F01D 11/005

See application file for complete search history.

(56) References Cited

U.S. PATENT DOCUMENTS

| | | | | |
|---|---|---|---|---|
| 3,572,733 A * | 3/1971 | Howald | F01D 9/065 | 277/411 |
| 6,095,751 A * | 8/2000 | Hirokawa | F01D 5/066 | 415/114 |
| 7,367,122 B2 * | 5/2008 | Yip | B23P 6/002 | 277/415 |
| 7,909,569 B2 * | 3/2011 | Durocher | F01D 25/005 | 415/108 |

(Continued)

FOREIGN PATENT DOCUMENTS

WO 2014051658 A1 4/2014

*Primary Examiner* — Justin D Seabe
*Assistant Examiner* — Michael L Sehn
(74) *Attorney, Agent, or Firm* — Bachman & LaPointe, P.C.

(57) ABSTRACT

A case assembly for a gas turbine engine, includes a case with a case boss, said case boss including a peripheral wall that defines a first inner diameter in a first condition to receive a piston seal, and a second inner diameter in a second condition, the second condition including enlargement of the first inner diameter to form a second inner diameter and a bushing mounted within the second inner diameter, an inner diameter of the bushing defines a bushing inner diameter about equivalent to the first inner diameter to receive the piston seal.

10 Claims, 7 Drawing Sheets

(56) References Cited

U.S. PATENT DOCUMENTS

| | | | | |
|---|---|---|---|---|
| 8,500,390 | B2 * | 8/2013 | Wojtyczka | F04D 29/526<br>415/173.4 |
| 2004/0219011 | A1 * | 11/2004 | Albers | F01D 11/16<br>415/174.2 |

* cited by examiner

SEALING INTERFACE FOR A CASE OF A GAS TURBINE ENGINE

CROSS REFERENCE TO RELATED APPLICATION

This application claims the benefit of provisional application Ser. No. 62/084,066, filed Nov. 25, 2014.

BACKGROUND

The present disclosure relates to a gas turbine engine and, more particularly, to a case therefore.

A Mid-Turbine Frame (MTF) assembly of a gas turbine engine typically includes a plurality of hollow vanes arranged in a ring-vane-ring structure. The rings define inner and outer boundaries of a core gas path while the vanes are disposed across the gas path. The MTF assembly, sometimes referred to as an inter-turbine frame, is located generally between a high pressure turbine stage and a low pressure turbine stage of a gas turbine engine to support one or more bearings and to transfer bearing loads through to an outer MTF case. The MTF assembly is thus a load-bearing structure.

Tie rods extend through the hollow vanes to interconnect an engine mount ring on the outer MTF case and a bearing compartment adjacent to an inner MTF case. The MTF assembly is subject to thermal and pressure stresses from combustion gases along the core gas path, such that the tie rods and service line are subject to high diametric tension. Such forces and pressures may eventually require replacement of the MTF inner case.

SUMMARY

A case assembly for a gas turbine engine according to one disclosed non-limiting embodiment of the present disclosure includes a case with a case boss, the case boss including a peripheral wall that defines an inner diameter for receipt of a piston seal.

A further embodiment of the present disclosure includes, wherein the case is an inner Mid-Turbine Frame case.

A further embodiment of any of the foregoing embodiments of the present disclosure includes, wherein the peripheral wall is of a thickness that is about twice as thick as that otherwise required to maintain acceptable stress levels for receipt of the piston seal.

A further embodiment of any of the foregoing embodiments of the present disclosure includes, wherein the peripheral wall defines a thickness of about 0.15" (3.8 mm).

A further embodiment of any of the foregoing embodiments of the present disclosure includes, wherein the case boss is a raised boss.

A further embodiment of any of the foregoing embodiments of the present disclosure includes, wherein the inner diameter includes a machined surface.

A further embodiment of any of the foregoing embodiments of the present disclosure includes, wherein the case is an inner Mid-Turbine Frame case, the case boss forms a sealed interface thereto.

A further embodiment of any of the foregoing embodiments of the present disclosure includes, a service line received at least partially through the case boss.

A further embodiment of any of the foregoing embodiments of the present disclosure includes, wherein the service line includes a flange.

A further embodiment of any of the foregoing embodiments of the present disclosure includes, an inner capture plate to retain the flange.

A further embodiment of any of the foregoing embodiments of the present disclosure includes an outer capture plate adjacent to the inner capture plate to retain a piston seal therebetween, the piston seal interfaces with the case boss.

A case assembly for a gas turbine engine according to another disclosed non-limiting embodiment of the present disclosure includes a case with an case boss, the case boss including a peripheral wall that defines a first inner diameter in a first condition to receive a piston seal, and a second inner diameter in a second condition, the second condition including enlargement of the first inner diameter to form a second inner diameter; and a bushing mounted within the second inner diameter, an inner diameter of the bushing defines a bushing inner diameter about equivalent to the first inner diameter to receive the piston seal.

A further embodiment of any of the foregoing embodiments of the present disclosure includes, wherein the case is an inner Mid-Turbine Frame case.

A further embodiment of any of the foregoing embodiments of the present disclosure includes, wherein the peripheral wall in the first condition is of a thickness that is about twice as thick as that otherwise required to maintain acceptable stress levels for receipt of the piston seal.

A method of reworking a case of a gas turbine engine according to another disclosed non-limiting embodiment of the present disclosure includes providing an case boss on the case, the case boss including a peripheral wall that defines a first inner diameter in a first condition to receive a piston seal; enlarging the case boss from the first inner diameter in the first condition to a second inner diameter in a second condition; and decreasing the second inner diameter in the second condition to be about equivalent to the first inner diameter to receive the piston seal.

A further embodiment of any of the foregoing embodiments of the present disclosure includes, wherein decreasing the second inner diameter includes inserting a bushing.

A further embodiment of any of the foregoing embodiments of the present disclosure includes, wherein decreasing the second inner diameter includes applying a coating.

A further embodiment of any of the foregoing embodiments of the present disclosure includes, wherein the piston seal provides a sealed interface with the case boss to seal a service line.

A further embodiment of any of the foregoing embodiments of the present disclosure includes, wherein the case is an inner Mid-Turbine Frame case.

A further embodiment of any of the foregoing embodiments of the present disclosure includes, wherein the peripheral wall in the first condition is abut twice the thickness of the peripheral wall in the second condition.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
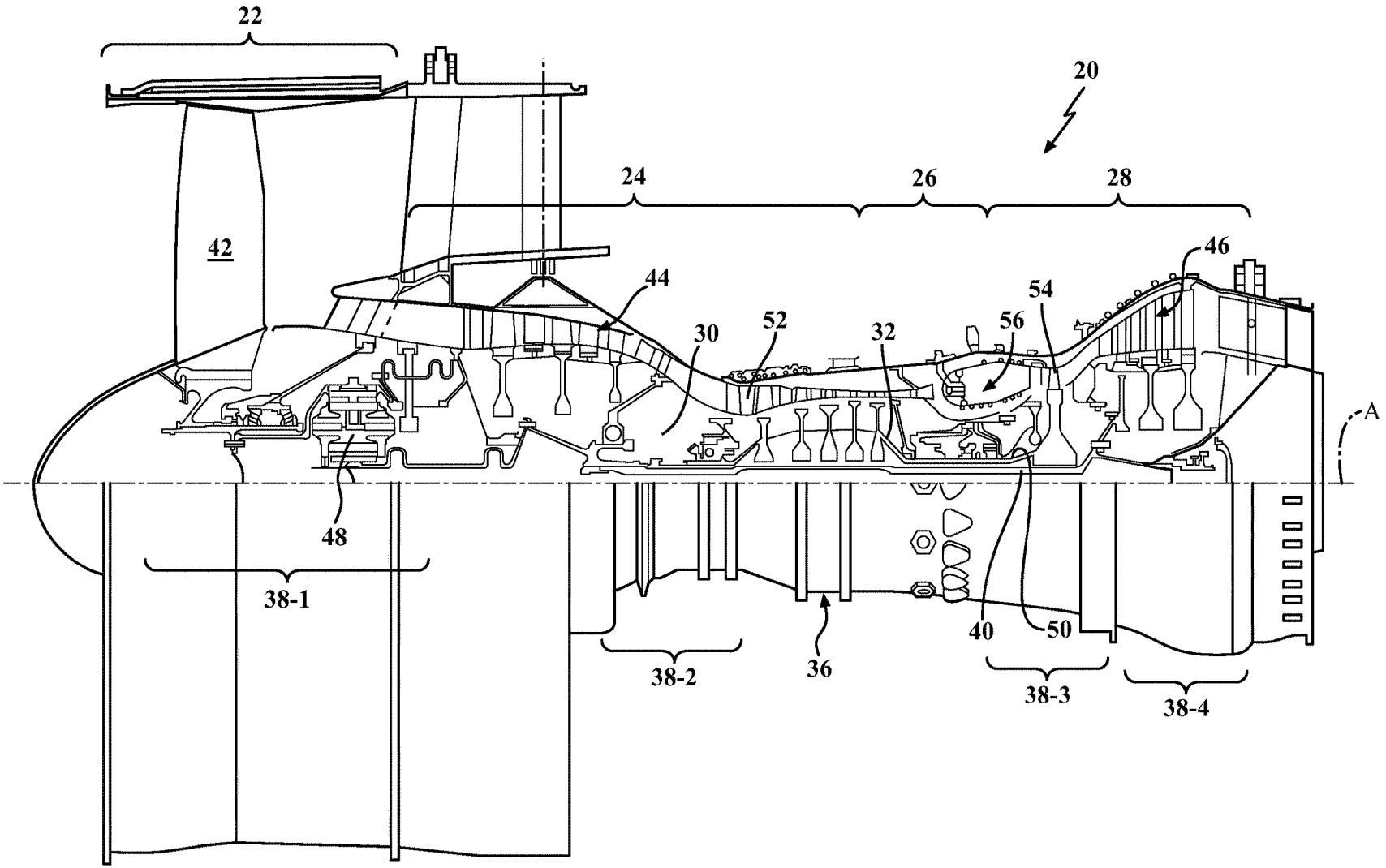
FIG. 1 is a schematic cross-sectional view of a geared architecture gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines architectures such as a low-bypass turbofan may include an augmentor section (not shown) among other systems or features. Although schematically illustrated as a turbofan in the disclosed non-limiting embodiment, it should be understood that the concepts described herein are not limited to use with turbofans as the teachings may be applied to other types of turbine engines to include but not limited to a three-spool (plus fan) engine wherein an intermediate spool includes an intermediate pressure compressor (IPC) between a low pressure compressor and a high pressure compressor with an intermediate pressure turbine (IPT) between a high pressure turbine and a low pressure turbine as well as other engine architectures such as turbojets, turboshafts, open rotors and industrial gas turbines.

The fan section 22 drives air along a bypass flowpath and a core flowpath while the compressor section 24 drives air along the core flowpath for compression and communication into the combustor section 26 then expansion through the turbine section 28. The engine 20 generally includes a low spool 30 and a high spool 32 mounted for rotation about an engine central longitudinal axis A relative to an engine case assembly 36 via several bearing compartments 38. The bearing compartments 38-1, 38-2, 38-3, 38-4 in the disclosed non-limiting embodiment are defined herein as a forward bearing compartment 38-1, a mid-bearing compartment 38-2 axially aft of the forward bearing compartment 38-1, a mid-turbine bearing compartment 38-3 axially aft of the mid-bearing compartment 38-2 and a rear bearing compartment 38-4 axially aft of the mid-turbine bearing compartment 38-3. It should be appreciated that additional or alternative bearing compartments may be provided.

The low spool 30 generally includes an inner shaft 40 that interconnects a fan 42, a low-pressure compressor ("LPC") 44 and a low-pressure turbine ("LPT") 46. The inner shaft 40 drives the fan 42 through a geared architecture 48 to drive the fan 42 at a lower speed than the low spool 30. The high spool 32 includes an outer shaft 50 that interconnects a high-pressure compressor ("HPC") 52 and high-pressure turbine ("HPT") 54. A combustor 56 is arranged between the HPC 52 and the HPT 54. The inner shaft 40 and the outer shaft 50 are concentric and rotate about the engine central longitudinal axis A that is collinear with their longitudinal axes.

Core airflow is compressed by the LPC 44 then the HPC 52, mixed with the fuel and burned in the combustor 56, then expanded over the HPT 54 and the LPT 46. The HPT 54 and the LPT 46 drive the respective high spool 32 and low spool 30 in response to the expansion.

In one example, the gas turbine engine 20 is a high-bypass geared architecture engine in which the bypass ratio is greater than about six (6:1). The geared architecture 48 can include an epicyclic gear system 58, such as a planetary gear system, star gear system or other system. The example epicyclic gear train has a gear reduction ratio of greater than about 2.3, and in another example is greater than about 2.5 with a gear system efficiency greater than approximately 98%. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one non-limiting embodiment, a significant amount of thrust is provided by the bypass flow due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one non-limiting embodiment of the example gas turbine engine 20 is less than about 1150 fps (351 m/s).

Figure 2:
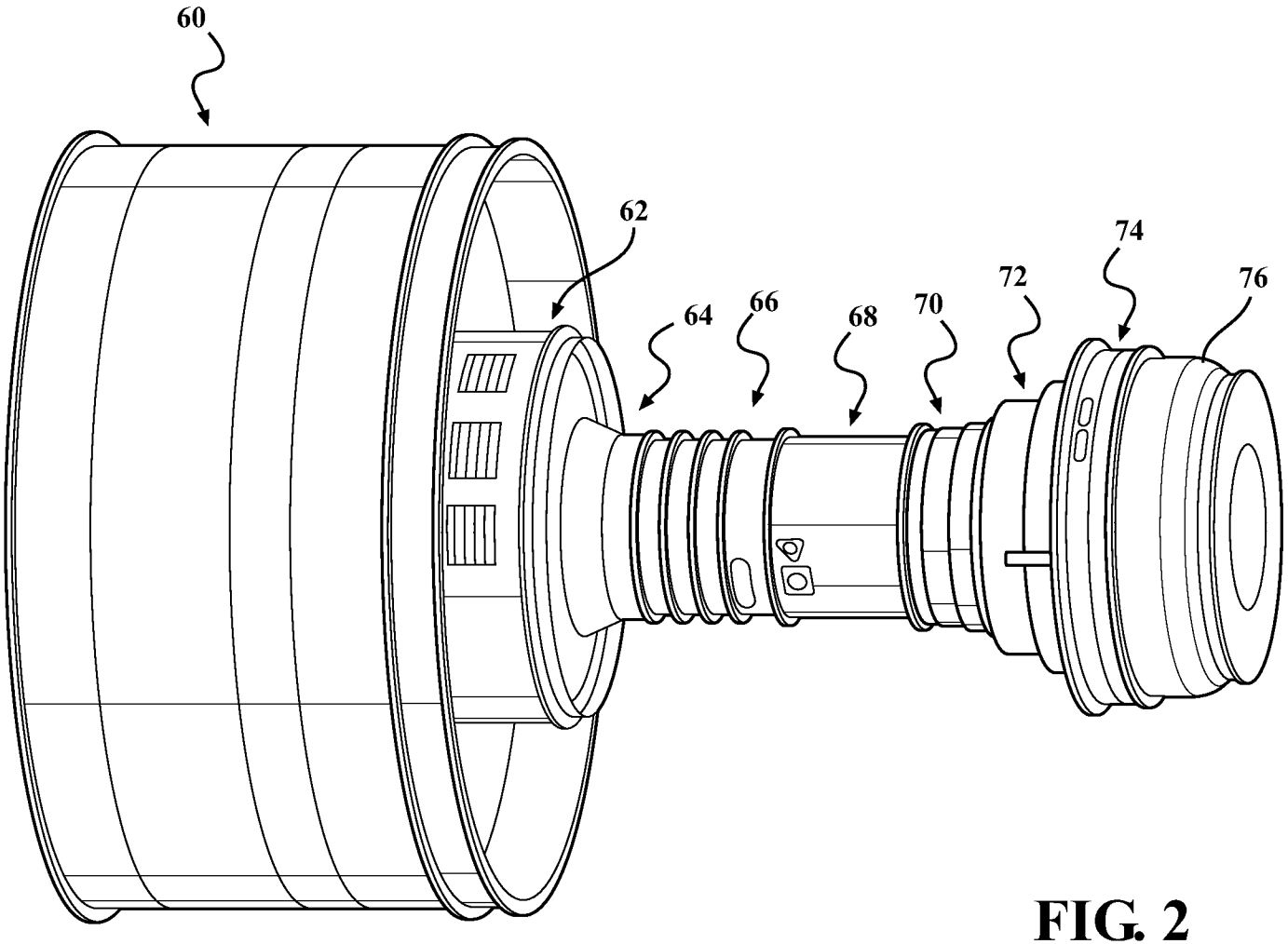
FIG. 2 is a perspective view of the engine modules.

With reference to FIG. 2, the engine case assembly 36 generally includes a plurality of modules, including a fan case module 60, an intermediate case module 62, a Low Pressure Compressor (LPC) module 64, a High Pressure Compressor (HPC) module 66, a diffuser module 68, a High Pressure Turbine (HPT) module 70, a mid-turbine frame (MTF) module 72, a Low Pressure Turbine (LPT) module 74, and a Turbine Exhaust Case (TEC) module 76. It should be understood that additional or alternative modules might be utilized.

Figure 3:
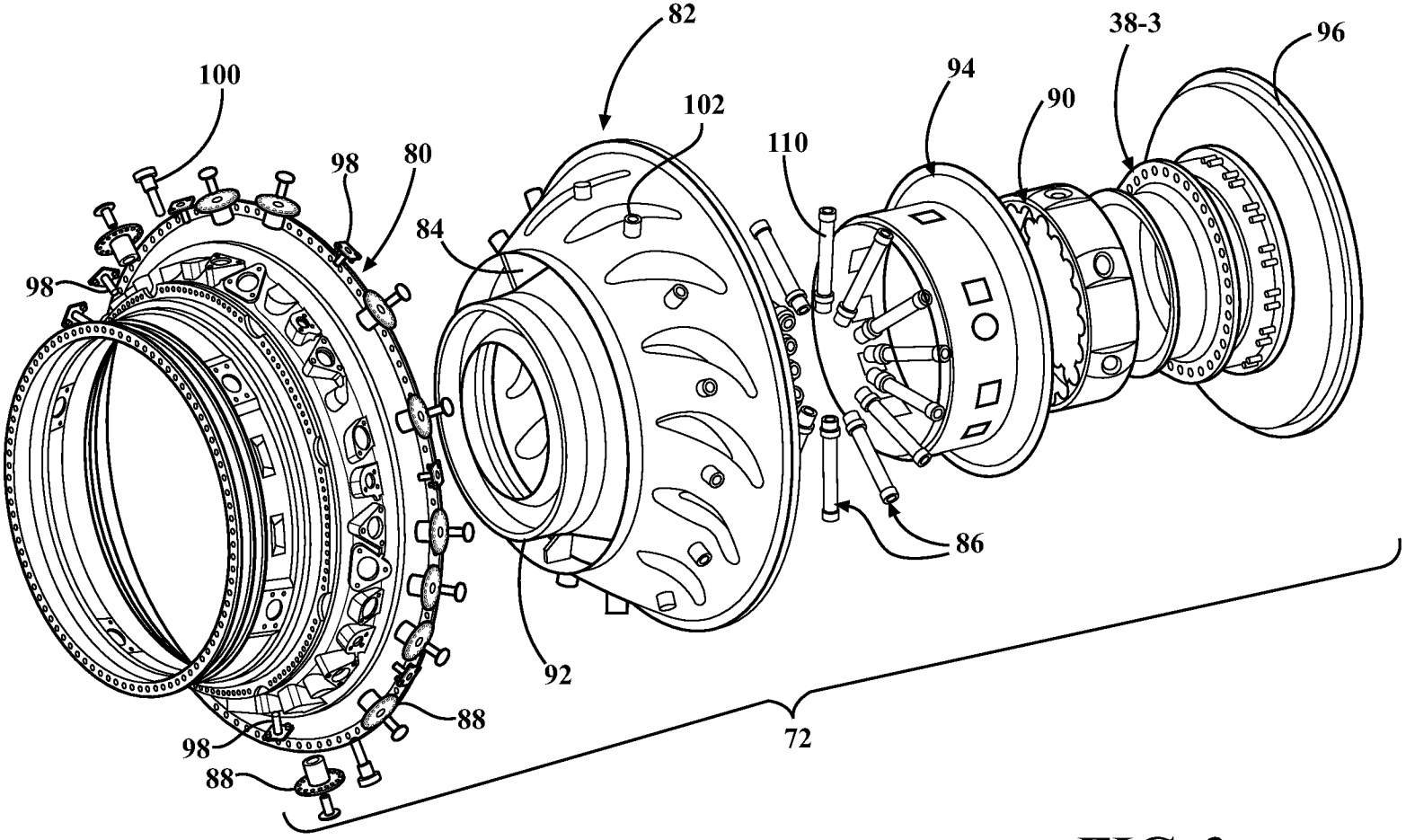
FIG. 3 is an exploded view of a Mid-Turbine Frame module.
Figure 4:
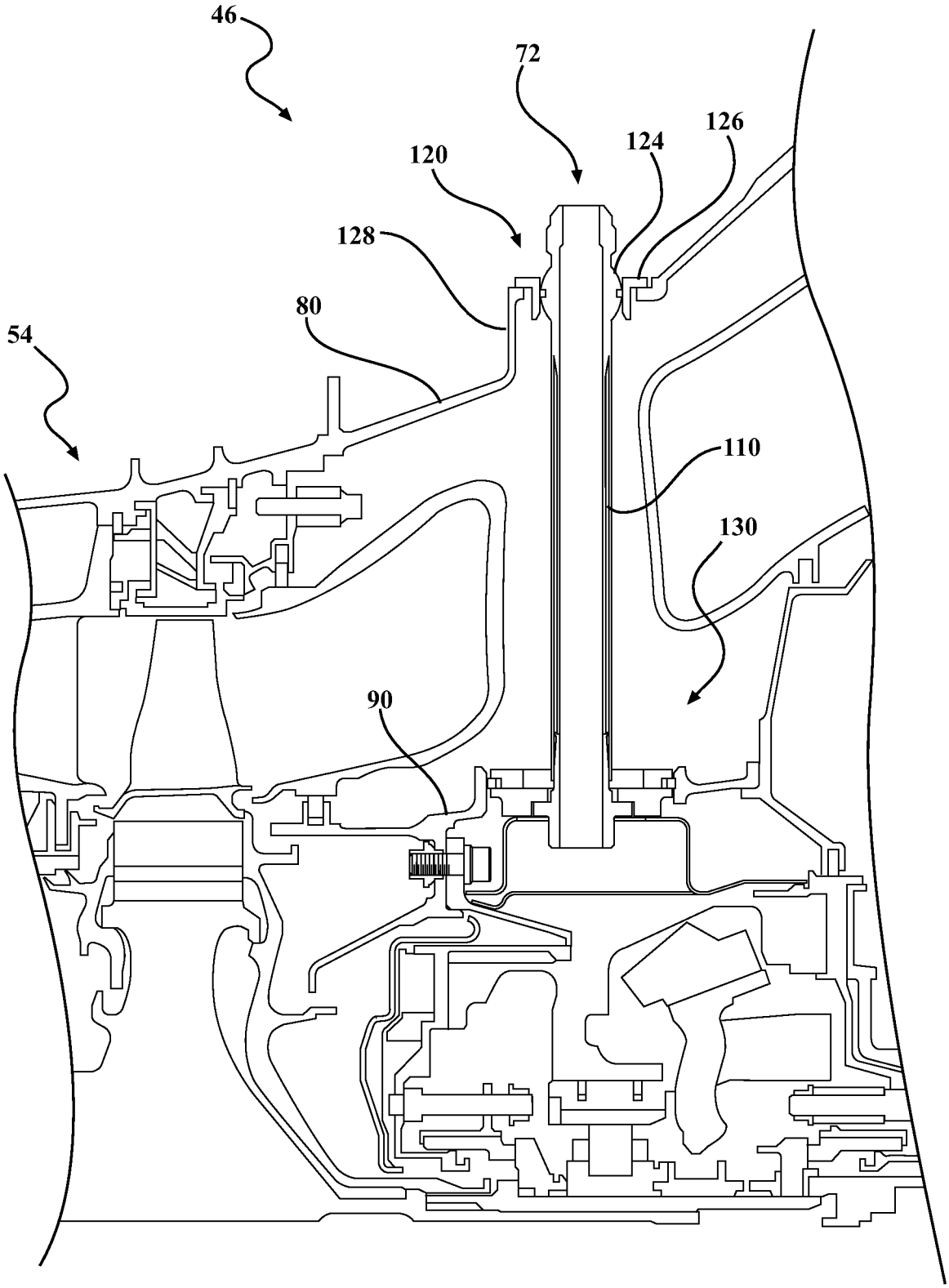
FIG. 4 is a cross-sectional view of the Mid-Turbine Frame module through a tie-rod.

With reference to FIG. 3, the MTF module 72 generally includes an outer MTF case 80, a mid-turbine frame (MTF) 82 with a multiple of hollow vanes 84, a multiple of tie rods 86, a multiple of tie rod nuts 88, an inner case 90, a HPT seal 92, a heat shield 94, a LPT seal 96, a multiple of centering pins 98, and a borescope plug assembly 100. The MTF module 72 supports the rear-bearing compartment 38-4 through which the inner and outer shafts 40, 50 are at least partially rotationally supported (FIG. 4). It should be appreciated that various other components may additionally or alternatively be provided within the MTF 82, for example only, the LPT seal 96 may alternatively be referred to as an intermediate seal in other engine architectures.

Each of the tie rods 86 are mounted to the inner case 90 and extend through a respective vane 84 to be fastened to the outer MTF case 80 with one of the multiple of tie rod nuts 88 that are at least partially received into a respective feature formed in the outer MTF case 80. That is, each tie rod 86 is sheathed by a vane 84 through which passes the tie rod 86 (FIG. 4). The multiple of tie rods 86 are circumferentially distributed through the vanes 84 to engage bosses 102 on the MTF 82 to locate the MTF 82 with respect to the inner case 90 and the outer MTF case 80.

Vanes 84 other than those which sheath a tie rod 86 may alternatively provide service paths there through via a service line 110 that operates as, for example, a buffer air conduit, oil supply conduit, an oil drain, an oil scavenge, etc. That is, each service line 110 is sheathed by one of the vanes 84 such as the tie rods 86. The service lines 110 are circumferentially interspersed with the tie rods 86. It should be understood that various attachment arrangements may alternatively or additionally be utilized.

With reference to FIG. 4, each service line 110 provides a sealed interface 120 at the outer MTF case 80, and a sealed interface 130 at the inner case 90. The outer sealed interface 120 generally includes a piston seal 124, a bushing 126 and an outer case boss 128 in the outer MTF case 80. The piston seal 124 is mounted to the service line 110 to interface with the bushing 126 that is respectively received into the outer case boss 128. It should be appreciated that various other configurations may be provided.

Figure 5:
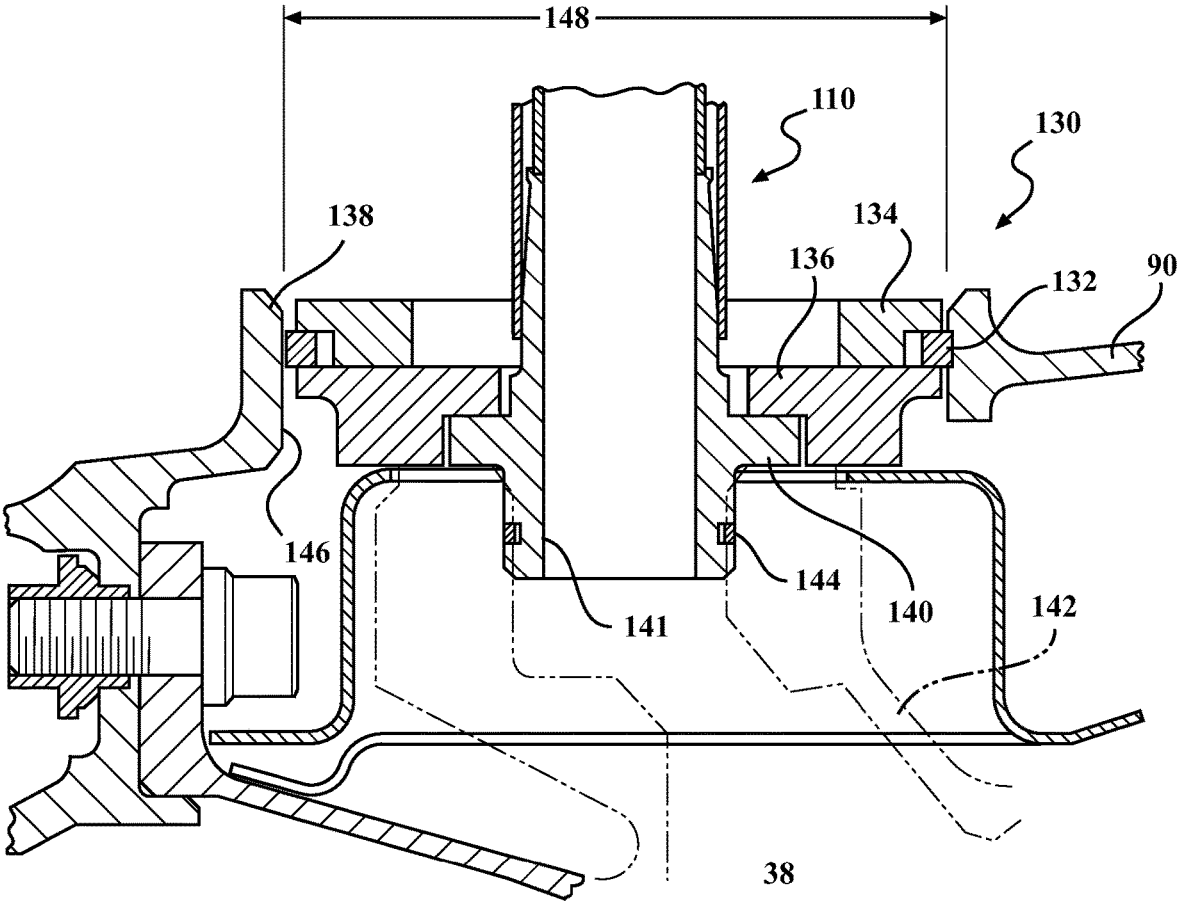
FIG. 5 is an expanded cross-sectional view of the inner MTF case of the Mid-Turbine Frame.

With reference to FIG. 5, the sealed interface 130 at the an inner case 90 generally includes a piston seal 132, an outer capture plate 134, an inner capture plate 136, and an inner case boss 138. The service line 110 includes a flange 140 that is retained between the inner capture plate 136 and a bearing support 142 of the bearing compartment 38. A distal end 141 of the service line 110 is received within the bearing support 142 and may be sealed thereto via a resilient seal 144.

The piston seal 132 is mounted between the outer capture plate 134 and the inner capture plate 136 to interface with the case boss 138. A peripheral wall 146 generally defines an inner diameter 148 of the case boss 138. The peripheral wall 146 is of increased thickness to facilitate reparability. The peripheral wall 146 is a thickness that is about twice as thick as that otherwise required to maintain acceptable stress levels for receipt of the piston seal 132. In one example, the peripheral wall 146 defines a thickness of about 0.15" (3.8 mm).

The sealed interface 130 at the inner case 90 is typically subject to relatively significant thermal and pressure loads that may eventually require rework from wear within the lifetime of the an inner case 90. That is, the case boss 138 is expected to wear due to the interface with the piston seal 132.

Figure 6:
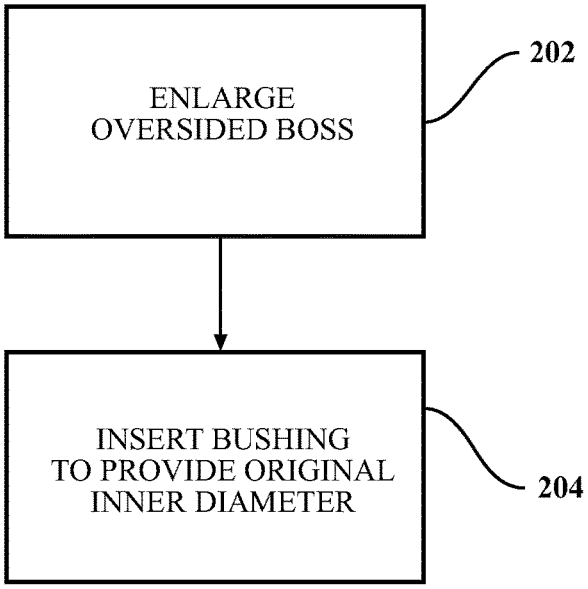
FIG. 6 is a method of reworking an engine case.

With reference to FIG. 6 one disclose non-limiting embodiment of a rework method 200 includes enlargement of the case boss 138 such as by drilling, machining, grinding or other operation (step 202). As the peripheral wall 146 defines a thickness that is about twice as thick as that otherwise required to maintain acceptable stress levels for receipt of the piston seal 132, suitable material thickness is provided for such enlargement. In one example, the thickness of the peripheral wall 146 is reduced by less than about one-half.

Figure 7:
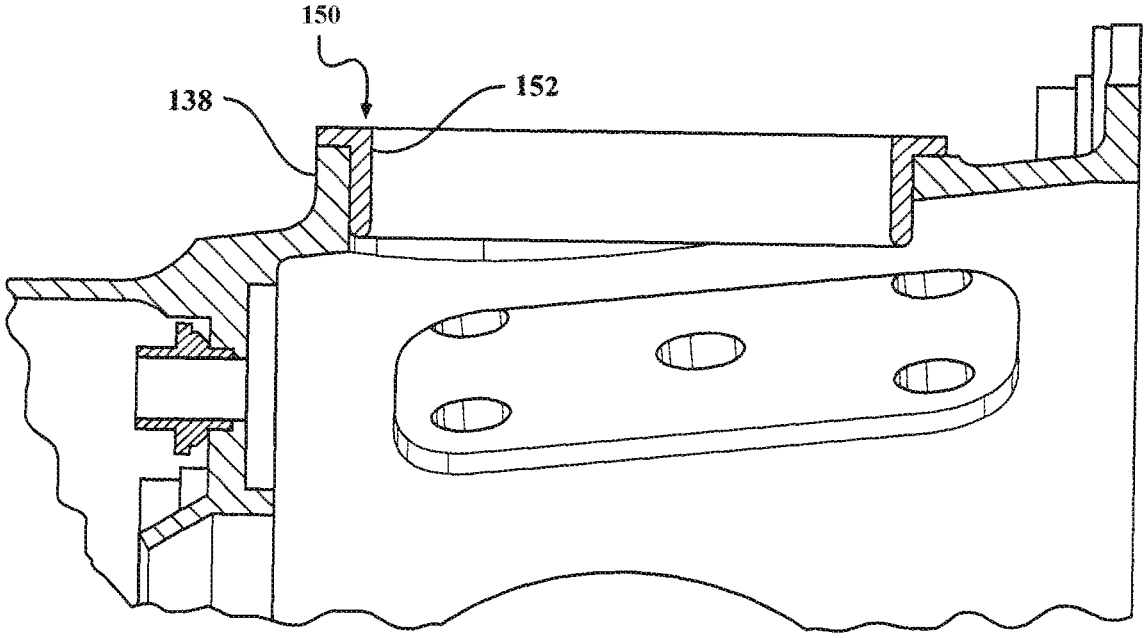
FIG. 7 is a sectional perspective view of a bushing mounted within the engine case.
Figure 8:
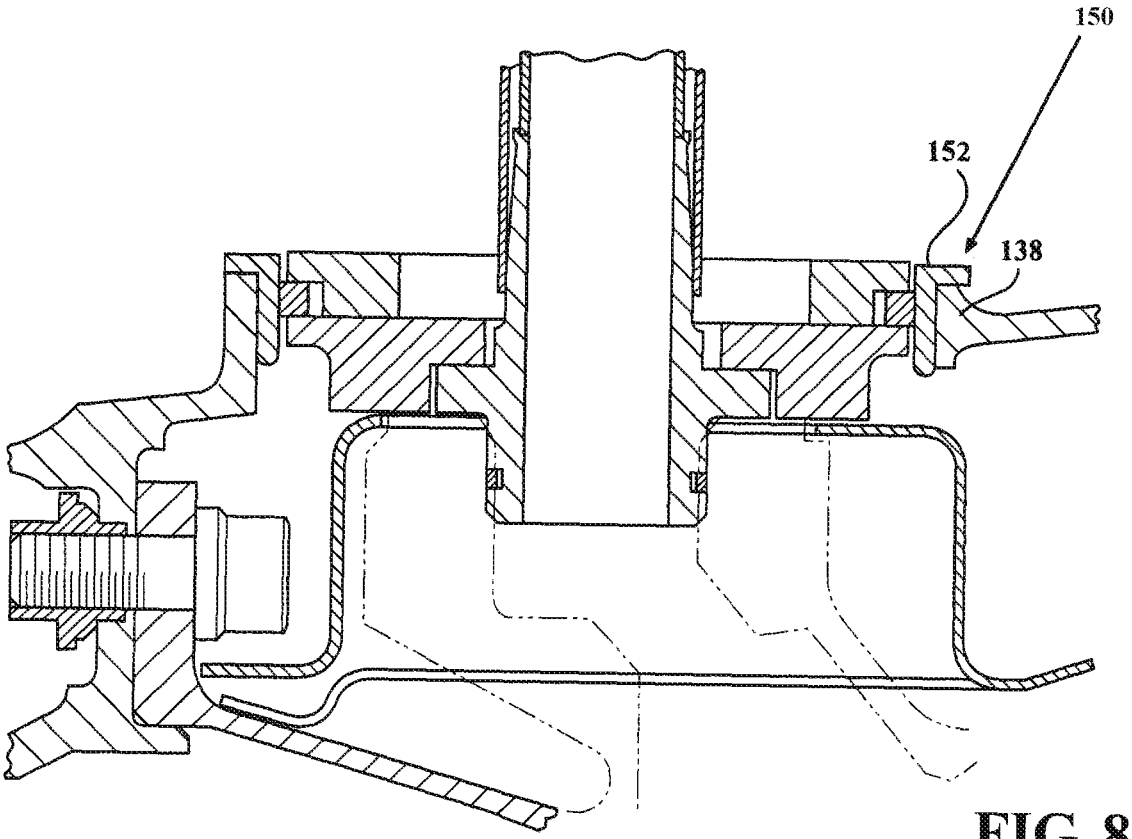
FIG. 8 is a sectional view of the engine case rework according to another disclosed non-limiting embodiment.
Figure 9:
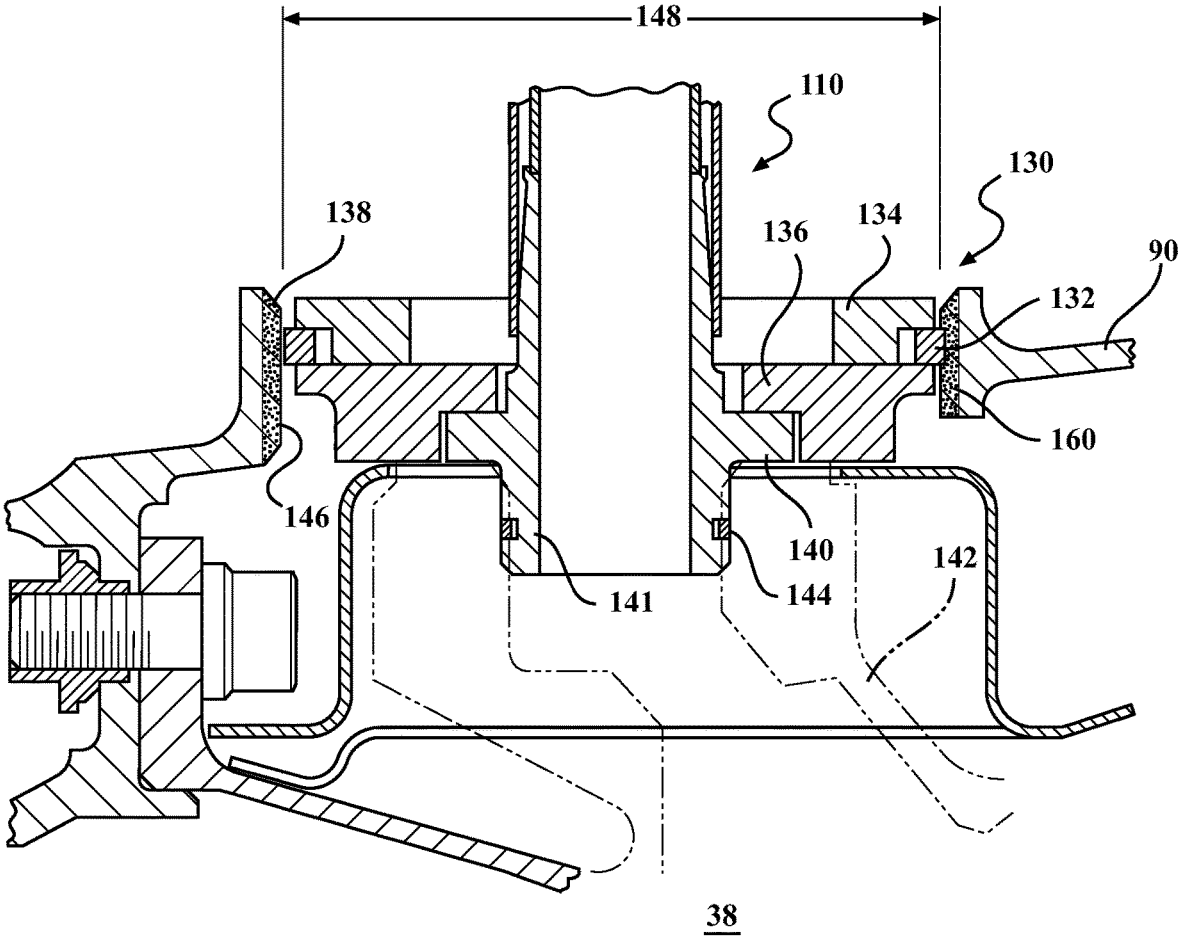
FIG. 9 is a sectional view of the engine case rework according to another disclosed non-limiting embodiment.

Next, a bushing 150 is located within the case boss 138 (step 204; FIGS. 7 and 8). The bushing 150 may be press fit or otherwise mounted into the enlarged inner case boss 138 such that an inner diameter 152 of the bushing 150 is equivalent to the original inner diameter 148 of the case boss 138. That is, the original material thickness of the case boss 138 permits the case boss 138 to be enlarged to receive the bushing 150 yet results in an equivalent inner diameter such that the same, or equivalent replacement piston seal 132, outer capture plate 134, and inner capture plate 136 are readily received therein.

In another disclosed non-limiting embodiment, subsequent to the enlargement, the bushing 150 may be replaced by a coating 160, such as a wear coating, a hard coating, or combination thereof. The coating 160 operates to increase the thickness of the peripheral wall 146 to again provide an inner diameter that is equivalent to the an inner diameter 148

The case boss facilitates maintenance and reparability as interface can be reworked instead of the heretofore required replacement of the entire MTF inner case.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A case assembly for a gas turbine engine, comprising:

an inner mid-turbine frame case with a case boss, said case boss comprising a peripheral wall that defines a first inner diameter in a first condition and a second inner diameter in a second condition, said second condition comprising an enlargement of said first inner diameter to form said second inner diameter;

a coating to increase a thickness of the peripheral wall within said second inner diameter, an inner diameter of said coating defines an inner diameter about equivalent to said first inner diameter;

a piston seal that interfaces with said coating;

a service line sheathed by a vane, the service line received at least partially through said case boss, said service line comprising a service line flange;

an inner capture plate; and an outer capture plate adjacent to said inner capture plate to retain said piston seal therebetween, wherein said flange is retained between the inner capture plate and a bearing support of a bearing compartment, said service line is sealed within the bearing support via a resilient seal.

2. The case assembly as recited in claim 1, wherein said peripheral wall defines a thickness of about 0.15" (3.8 mm).

3. The case assembly as recited in claim 1, wherein said case boss is a raised boss.

4. The case assembly as recited in claim 1, wherein said first inner diameter includes a machined surface.

5. The case assembly as recited in claim 1, wherein said case is an inner mid-turbine frame case, said case boss forms a sealed interface thereto.

6. The case assembly as recited in claim 1, wherein said service line is one of a multiple of service lines that are circumferentially interspersed with a tie rod.

7. A case assembly for a gas turbine engine, comprising:

an inner mid-turbine frame case with a raised case boss comprising a peripheral wall that defines a first inner diameter in a first condition and a second inner diameter in a second condition, said second condition comprising enlargement of said first inner diameter to form said second inner diameter; and a bushing mounted within said second inner diameter, an inner diameter of said bushing defines a bushing inner diameter about equivalent to said first inner diameter to receive a piston seal;

a piston seal that interfaces with said bushing;

a service line sheathed by a vane, the service line received at least partially through said case boss, said service line comprising a flange;

an inner capture plate to retain said flange; and an outer capture plate adjacent to said inner capture plate to retain said piston seal therebetween, wherein said flange is retained between the inner capture plate and a bearing support of a bearing compartment, said service line is sealed within the bearing support via a resilient seal.

8. A method of reworking a case of a gas turbine engine, comprising:

enlarging a case boss of an inner mid-turbine frame case, the case boss comprising a peripheral wall that defines a first inner diameter in a first condition to a second inner diameter in a second condition, the peripheral wall in the first condition about twice the thickness of the peripheral wall in the second condition; and decreasing the second inner diameter in the second condition to be about equivalent to the first inner diameter to receive a piston seal, wherein the piston seal provides a sealed interface with the case boss to seal a service line sheathed by a vane, a flange of the service line retained between an inner capture plate and a bearing support of a bearing compartment.

9. The method as recited in claim 8, wherein decreasing the second inner diameter includes inserting a bushing.

10. The method as recited in claim 8, wherein decreasing the second inner diameter includes applying a coating.

* * * * *